US007278544B2

(12) United States Patent
Blateri

(10) Patent No.: US 7,278,544 B2
(45) Date of Patent: Oct. 9, 2007

(54) SYSTEM AND METHOD FOR STORING AND DISPENSING ITEMS

(75) Inventor: Frank Blateri, Coppell, TX (US)

(73) Assignee: Diani, LLC, Dallas, TX (US)

( * ) Notice: Subject to any disclaimer, the term of this patent is extended or adjusted under 35 U.S.C. 154(b) by 266 days.

(21) Appl. No.: 10/954,563

(22) Filed: Sep. 30, 2004

(65) Prior Publication Data

US 2006/0065611 A1 Mar. 30, 2006

(51) Int. Cl.
*A47G 29/00* (2006.01)

(52) U.S. Cl. ..... 211/85.15; 211/12; 211/44

(58) Field of Classification Search ..... 211/85.15, 211/85.28, 85.5, 12, 85.18, 44, 55, 52, 126.12, 211/189, 87.01; 248/201, 266, 267, 311.1, 248/270, 271, 268, 311.2, 905; 225/42; 242/594, 242/594.5, 594.6, 170, 598.1, 598.6
See application file for complete search history.

(56) References Cited

U.S. PATENT DOCUMENTS 2,726,825 A * 12/1955 Ziskin et al. ..... 242/594.5
3,317,099 A * 5/1967 Solomon ..... 225/23
3,595,511 A * 7/1971 Summerville, Jr. ..... 248/264
3,603,519 A * 9/1971 Brown et al. ..... 242/594.1
4,094,416 A * 6/1978 Smith ..... 211/85.28
4,097,002 A * 6/1978 Krueger ..... 242/596.1
4,645,107 A * 2/1987 Norris ..... 225/37
4,981,224 A * 1/1991 Rushing ..... 211/126.12
5,082,159 A * 1/1992 Gutierrez ..... 225/34
5,143,230 A * 9/1992 LaCorte ..... 211/85.28
5,277,351 A * 1/1994 McCullagh ..... 225/38
5,904,329 A * 5/1999 Kanome et al. ..... 248/201
6,402,085 B1 * 6/2002 Smith ..... 242/578
6,955,268 B2 * 10/2005 Waldron ..... 211/51
7,000,520 B2 * 2/2006 Nichols et al. ..... 83/578
7,036,701 B2 * 5/2006 Garcia ..... 225/1

* cited by examiner

*Primary Examiner*—Jennifer E. Novosad
(74) *Attorney, Agent, or Firm*—Haynes and Boone, LLP

(57) ABSTRACT

A system and method for storing items, such as food wrapping products, according to which two or more stacked modules are provided with each being adapted to store, and permit the dispensing of, a plurality of items.

11 Claims, 3 Drawing Sheets

SYSTEM AND METHOD FOR STORING AND DISPENSING ITEMS

BACKGROUND

This invention relates to a system and method for storing and dispensing a plurality of items such as products for wrapping and/or storing food.

Products for wrapping and/or storing food are very common and include rolls of sheet material, such as foil, wax paper, plastic sheets, and the like, as well as bags made of various types of plastic and paper. These products are often sold in a package, or box, that has a slot or opening to permit the rolled sheet material, or the bags, to be removed from the box. However when these boxes are stacked in a cabinet or drawer for storage, it is difficult to pull the sheet material and the bags out from the storage boxes.

Therefore what is needed is a storage system for storing various items while enabling the items to be easily accessed, and the present invention addresses this need.

DETAILED DESCRIPTION

Figure 1:
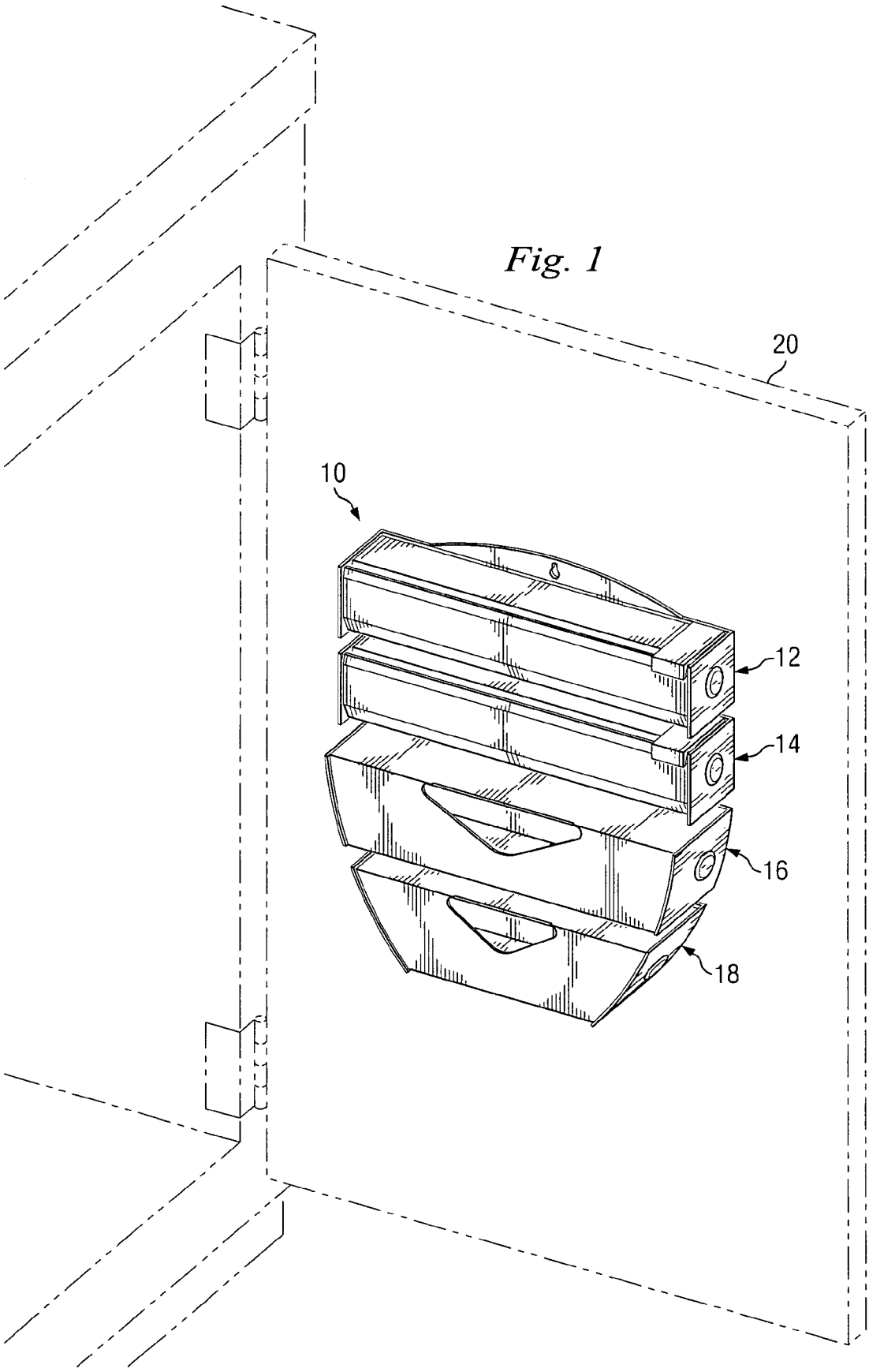
FIG. 1 is an isometric view of a storage system according to an embodiment of the invention, shown mounted to a support surface.

Referring to FIG. 1 of the drawing a storage system according to an embodiment of the invention is referred to, in general, by the reference numeral 10. The system consists of four storage modules 12, 14, 16, and 18 disposed in a stacked, or vertically-spaced, relation. It is understood that the system 10 can be affixed to the inner surface of a door 20 of a cabinet, pantry, or closet, in any conventional manner, such as by hooks, screws, hooks and loops, or any other type of fasteners.

Figure 2:
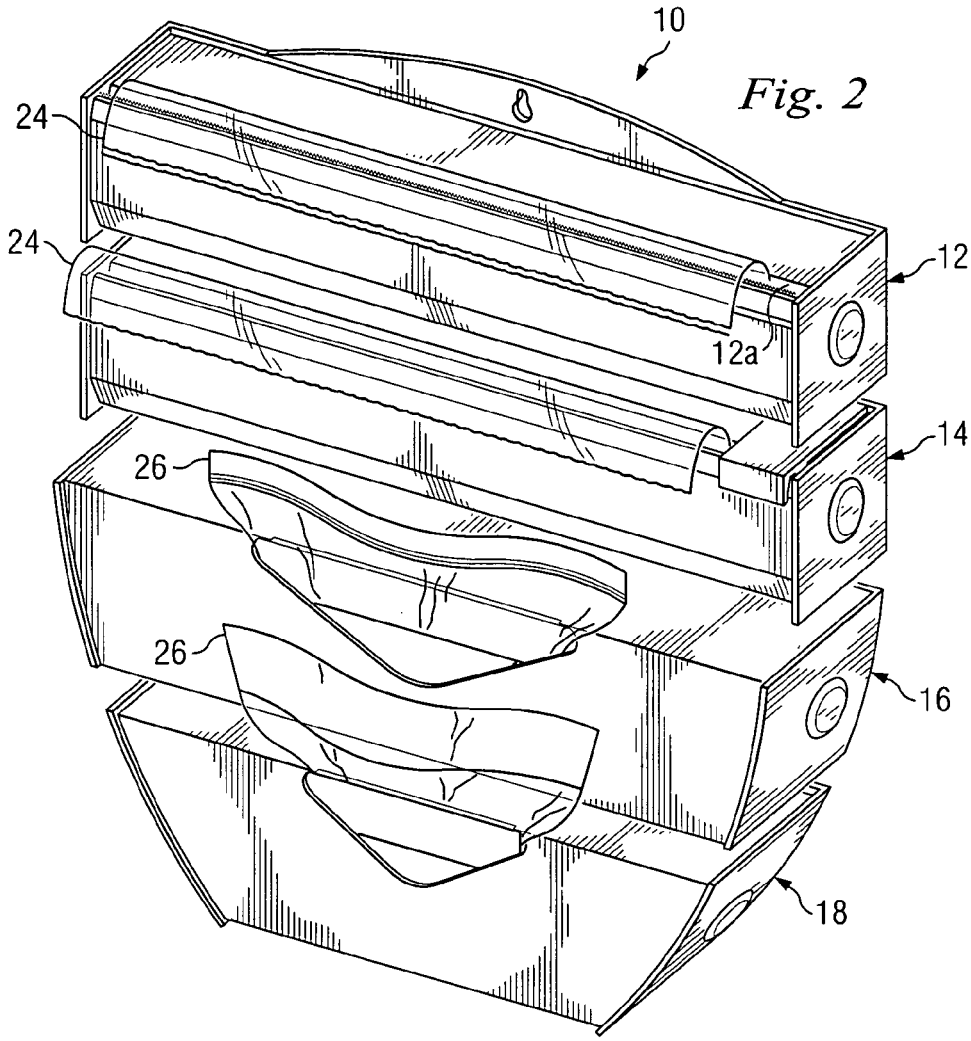
FIG. 2 is an enlarged view of the embodiment of FIG. 1 and depicting the materials being dispensed.

As shown in FIG. 2, the module 12 is designed to accommodate a roll of a sheet material, such as food wrapping material 24, which can be in the form of foil, paper, plastic, or the like. The material 24 can be one continuous rolled sheet, or a series of non-continuous rolled sheets, both of which are conventional and readily available in retail markets. The module 12 is generally rectangular in shape and defines an interior for receiving the roll of sheet material 24 which preferably is kept in its original box, or package, for reasons to be described. The leading end portion of the sheet material 24 is pulled from its original box, or package, and through an elongated slot 12*a* in the module 12 that extends for substantially the entire width of the module.

The module 14 extends just below the module 12 as viewed in FIGS. 1 and 2 and is connected to the module 12 in a manner to be described. With one exception to be discussed later, the module 14 is identical to the module 12 and therefore will not be described in detail. The module 14 is also adapted to dispense a roll of material 24.

The module 16 extends just below the module 14 and is connected to the module 14 in a manner to be described. The module 16 is designed to receive and dispense a series of stacked items, such as food storage bags 26. The module 16 is generally rectangular in shape with slightly tapered side walls to define an interior for receiving the bags 26. Preferably, the original box or package containing the bags can be placed in the module 16 and the bags dispensed from an opening in the latter box or package and through the module 16. To this end, a relatively large, triangularly-shaped, opening 16*a* is formed through the module 16 through which the bags 26 can be pulled.

The module 18 extends just below the module 16 as viewed in FIGS. 1 and 2 and is connected to the module 16 in a manner to be described. The module 18 is identical to the module 16 with the exception that it is slightly smaller than the module 16. The tapers of each side wall of the modules 16 and 18 are such that, when assembled, they form a continuous tapered surface. The module 18 is also adapted to dispense a series of storage bags 26.

Figure 3:
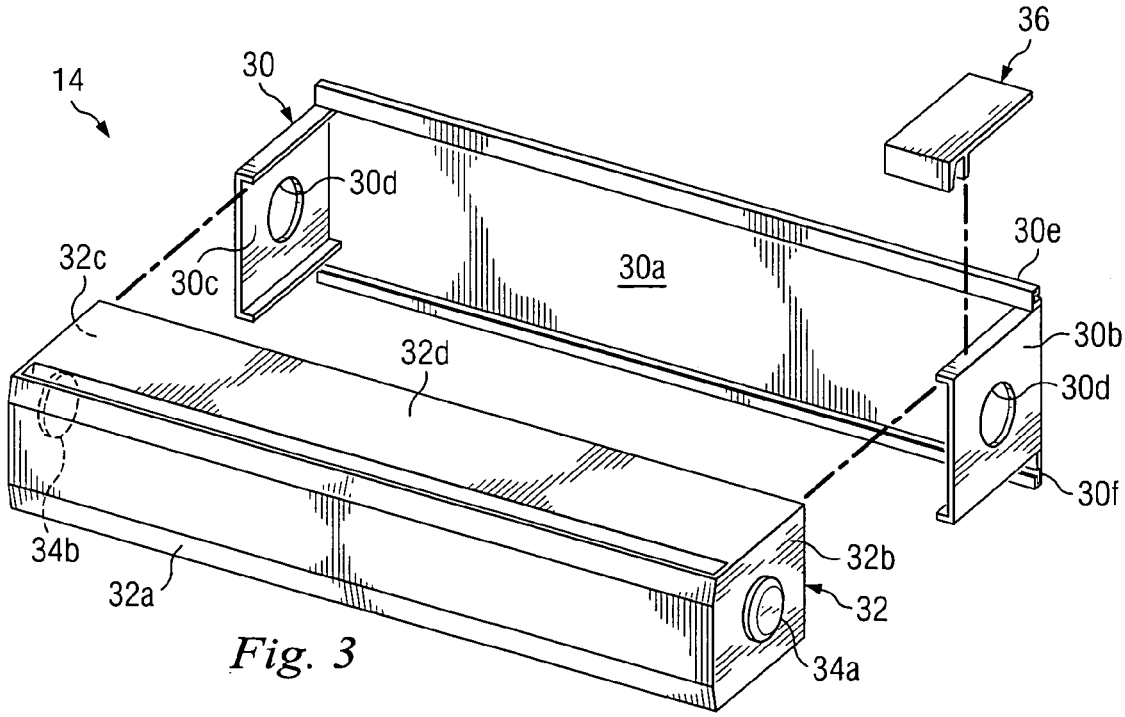
FIG. 3 is an exploded isometric view of a module of the embodiment of FIG. 1.

Referring to FIG. 3, the module 12 consists of a mounting bracket 30 that rests against a support structure such as the door 20 (FIG. 1) and receives and supports a drawer, or housing 32. The mounting bracket 30 includes a back panel 30*a* and two side panels 30*b* and 30*c* extending from the back panel. A circular opening 30*d* is formed in each of the side panels 30*b* and 30*c*, and two connecting tabs 30*e* and 30*f* extend from the upper and lower edges, respectively, of the back panel 30*a*, for reasons to be described.

The housing 32 includes a front panel 32*a*, two side panels 32*b* and 32*c*, an upper panel 32*d*, and a lower panel (not shown). The slot 12*a* is formed in the top panel 32*a* of the housing 32. The width and height of the housing 32 are slightly less than the width and height, respectively, of the bracket 30 so that the housing 32 can fit in the bracket 30 to form an enclosure for storing the roll of sheet material 24. In this context, each side panel 30*b* and 30*c* of the bracket 30 has two flanges extending inwardly from its respective upper and lower edges, to receive the housing 32.

As a non-limiting example of a manner in which the housing 32 is locked to the bracket 30, two protruding members, in the form of circular knobs 34*a* and 34*b* are mounted on, and project outwardly from, the two side panels 32*b* and 32*c*, respectively, and are adapted to extend in the two openings 30*d*, respectively, in the bracket 30, as will be described in detail.

Figure 4:
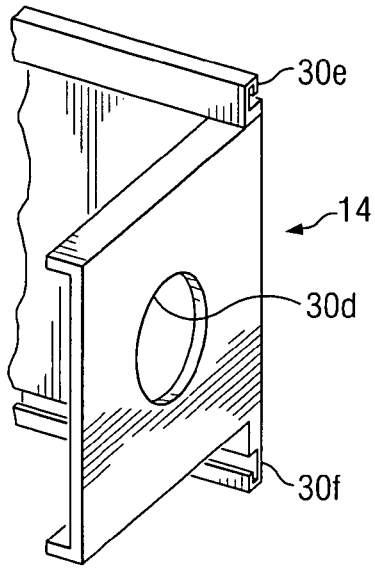
FIG. 4 is an enlarged partial isometric view showing a portion of the module of FIG. 3.
Figure 5:
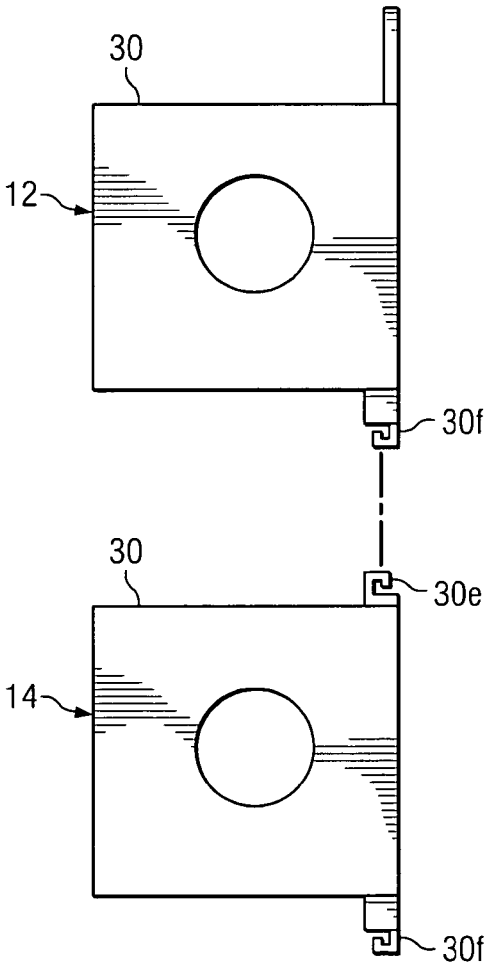
FIG. 5 is a side elevational view of the two modules of FIG. 1 shown in a spaced relationship.
Figure 6:
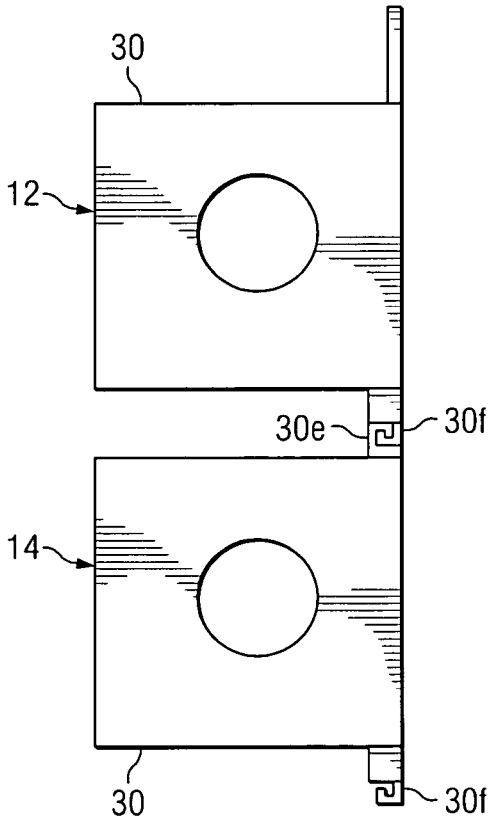
FIG. 6 is a side elevational view of the modules of FIG. 5 shown connected.

FIGS. 4-6 depict a non-limiting example of the manner in which the mounting brackets of the modules 12 and 14 can be connected. In particular the tab 30*e* extends from the upper edge of the back panel 30*a* of the bracket 30 of the module 14, and has a "J", or hook-shaped cross section which is upside down as viewed in FIG. 5. Similarly, the tab 30*f* extends from the lower edge of the back panel 30*a* of the bracket 30 of the module 12 which also has a "J", or hook-shaped cross section that is reversed with respect to the tab 30*e*. The tab 30*f* of the bracket 30 of the module 12 interlocks with the tab 30*e* of the bracket 30 of the module 14, as shown in FIG. 6, to connect the brackets 30 of each module 12 and 14.

A tab 30*f* is provided on the lower edge of the back panel of the bracket 30 of the module 14 which interlocks with a tab (not shown) on the module 16 that is identical to the tab 30*e*. Although not shown, it is understood that a tab identical to the tab 30*f* is provided on the lower edge of the back panel of the bracket 30 of the module 16 that interlocks with a tab identical to the tab 30*e* on the module 18. Thus, an unlimited number of modules can be stacked and connected in the above manner.

As shown in FIGS. 1 and 2, the upper module 12 does not have a tab with a "J", or hook-shaped cross section, but rather has a curved tab that is not adapted to interlock, but rather is more attractive from an aesthetic standpoint. The latter tab is provided with an opening for receiving a fastener to fasten the system 10 to a support structure, such as the door 20 in FIG. 1.

Once the brackets 30 of the modules 12, 14, 16, 18, and 20 are connected in the above matter and fastened to a vertical support surface, such as the door 20 shown in FIG. 1, the roll of sheet material 24, contained in its original package, can be inserted into the interior of the housing 32 of the module 14 through the open rear thereof. The housing 32 is then aligned with the bracket 30, and, more particularly with the above mentioned flanges disposed on the side panels 30*b* and 30*c* of the bracket. The housing 32 can then be pushed towards the rear of the bracket 30, and, the latter panels can flex slightly outwardly to permit the knobs 34*a* and 34*b* to extend in the openings 32*d*, thus locking the housing 32 to the bracket 30. An enclosure is thus formed that contains the roll of sheet material 24. The leading end portion of the material 24 is passed through the slot 12*a* in the top panel 32*c* of the housing 32 to permit the material 24 to be dispensed from its original package and from the module 14. Assuming that the roll of material 24 is continuous and not precut, once the desired length of sheet material 24 is pulled from the module 12, the serrations of the original packing can be used to tear the material.

A roll of material, identical to the material 24, can also be inserted in, and dispensed from, the module 12 in the above manner, and a plurality of different items, such as the food storage bags 26, or the like, can be inserted in, and dispensed from the modules 16 and 18. In each case, the roll of sheet material 24 and the food storage bags 26 can be inserted in the housing of the particular module, and the housing can then be connected to its corresponding bracket in the manner described above.

As shown in FIG. 3, according to an alternate embodiment, the desired length of sheet material 24 can be cut from the roll of material using a cutting bracket 36 that includes two slightly-spaced, downwardly extending, flanges that receive a cutting blade, or the like (not shown). For the purpose of example, the bracket 36 is shown in connection with the module 14 in FIGS. 1-3 and would normally rest on the upper surface of the module. To cut the material 24, manual pressure can be applied to the bracket 36 in a downward direction, and the bracket then moved in a direction from right-to-left as viewed in FIGS. 1 and 2 so that the blade cuts the material 24. In this context, a sliding track (not shown) could be provided on the housing 32.

It is understood that a cutting bracket, identical to the cutting bracket 36, can be associated with the module 12.

The modules 12, 14, 16, and 18 can be fabricated of any material that is consistent with the uses described above. For example, each module 12, 14, 16, and 18 could be fabricated from a plastic material, or from a metal material. Also, the bracket 30 of each module could be fabricated from a plastic material and the housing 32 could be fabricated from a metal, or vice versa. In the event the buttons 34*a* and 34*b* and the openings 32*d* are used to connect each housing 32 to its corresponding bracket 30, at least one of the housing and bracket would be fabricated from a flexible material.

Variations may be made in the foregoing without departing from the scope of the invention. Examples of the variations are as follows:

(1) The housing 32 can be locked to the bracket 30 in a manner other than by the knobs 34*a* and 34*b*, such as by locking screws, pins buttons, tabs, etc.

(2) The adjacent modules can be connected together in a manner other than by the tabs 30*e* and 30*f*, such as by screws or any other interlocking techniques.

(3) The number of modules 10 can be varied (4) The roll of sheet material 24 or the bags 26 can be removed from their original boxes, or packages, prior to being placed in the modules 12, 14 and 16, 18, respectively. In the former case, the cutting bracket 36 can be used, or one surface of the module 12 defining the slot 12*a* can be serrated for permitting the sheet material 24 to be cut, or the cutting bracket 36 can be used.

(5) Only one knob 34*a* or 34*b* can be provided.

(6) The knobs 34*a* and 34*b* can be provided on the bracket and the openings for receiving the knobs can be provided on the housing.

(7) The number and configuration of the panels making up the bracket 30 and the housing 32 can be varied.

(8) Spatial references, such as "upper", "lower", "top", "bottom", "side", etc. are for the purpose of illustration only and do not limit the specific orientation or location of the elements described above.

(9) The above embodiments are not limited to storing sheet material and food storage bags, but rather can be used to store other items.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A system for storing a plurality of items, the system comprising:

a first bracket having an interlocking tab formed thereon;

a first housing releasably locked to the first bracket and forming, with the first bracket, an enclosure for storing items and permitting dispensing of the items;

a second bracket having an interlocking tab formed thereon that is interlocked with the tab of the first bracket; and a second housing releasably locked to the second bracket and forming, with the second bracket, an enclosure for storing items and permitting dispensing of the items;

wherein each bracket comprises a back panel and two side panel members extending from the back panel;

wherein each housing comprises two side panel members that are adapted to extend within, and are adjacent to, the respective side panel members of the corresponding bracket;

wherein an opening is formed through at least one housing to permit the corresponding items to be dispensed; and wherein the system further comprises a protruding member disposed on each of the side panel members of the housings, each protruding member extending in an opening formed in the respective adjacent side panel member of the corresponding bracket, thereby releasably locking the housings to the corresponding brackets.

2. The system of claim 1 wherein the first bracket extends above the second bracket, wherein the tab of the first bracket extends from a lower surface thereof, and wherein the tab of the second bracket extends from an upper surface thereof.

3. The system of claim 2 wherein the first bracket is adapted to be connected to a vertical support surface and wherein the second bracket is support by the first bracket.

4. The system of claim 2 wherein the tabs have substantially hooked-shaped cross sections that engage to interlock.

5. The system of claim 1 wherein each of the items comprises a continuous sheet material and wherein a portion of the at least one housing defining the opening is serrated to cut the corresponding continuous sheet material.

6. The system of claim 1 wherein each of the items comprises a continuous sheet material and further comprising a cutter supported by, and adapted to slide across, the at least one housing to cut the corresponding continuous sheet material.

7. A system comprising:

first and second items, each of the first and second items comprising a continuous sheet material;

a first bracket having two flexible side panels;

a first housing supported by the first bracket and disposed between the flexible side panels of the first bracket, the first housing forming, with the first bracket, an enclosure that stores the first item and permits the dispensing of the first item;

a second bracket having two flexible side panels;

a second housing supported by the second bracket and disposed between the flexible side panels of the second bracket, the second housing forming, with the second bracket, an enclosure that stores the second item and permits the dispensing of the second item; and means for connecting the first bracket and the second bracket together;

wherein the flexible side panels are flexed into engagement with their corresponding housings to support the housings;

wherein each housing comprises two side panels that extend within, and are adjacent to, the respective flexible side panels of the corresponding bracket;

wherein the system further comprises a protruding member disposed on each of the side panels of the housings, the protruding members extending in respective openings formed in the corresponding adjacent flexible side panels, thereby retaining each housing in its corresponding bracket;

wherein the flexible side panels of the brackets are flexed to permit the protruding members to extend through the respective openings;

wherein the first bracket is adapted to be connected to a vertical support surface;

wherein the second bracket is supported by the first bracket; and wherein a slot is formed through at least one housing to permit the corresponding continuous sheet material to be dispensed.

8. The system of claim 7 wherein the connecting means comprises tabs formed on the respective brackets and adapted to interlock.

9. The system of claim 8 wherein the tabs have substantially hooked-shaped cross sections that engage to interlock.

10. The system of claim 7 wherein a portion of the at least one housing defining the slot is serrated to cut the corresponding continuous sheet material.

11. The system of claim 7 further comprising a cutter supported by, and adapted to slide across, the at least one housing to cut the corresponding continuous sheet material.

* * * * *